US005221152A

United States Patent [19]

Chuang

[11] Patent Number: 5,221,152

[45] Date of Patent: Jun. 22, 1993

[54] WRITING INSTRUMENT WITH CAP

[75] Inventor: Cheng-Hwa Chuang, Taipei, Taiwan

[73] Assignee: Pioneer Industrial Corp., Taipei, Taiwan

[21] Appl. No.: 893,198

[22] Filed: Jun. 2, 1992

[30] Foreign Application Priority Data

Mar. 19, 1992 [JP] Japan ..... 4-14874[U]

[51] Int. Cl.[5] ..... B43K 9/00; B43K 27/04

[52] U.S. Cl. ..... 401/57; 24/11 F; 401/90; 401/98; 401/202; 401/243

[58] Field of Search ..... 401/202, 243, 244, 246, 401/57, 90, 98, 243, 202; 24/11 M, 11 F, 11 R

[56] References Cited

U.S. PATENT DOCUMENTS

| | | | |
|---|---|---|---|
| D. 254,315 | 2/1980 | Carre . | |
| D. 259,642 | 6/1981 | Gomez . | |
| D. 259,793 | 7/1981 | Carre . | |
| D. 263,482 | 3/1982 | Carre . | |
| D. 270,843 | | Itoh . | |
| D. 273,400 | 4/1984 | Zierhut . | |
| D. 305,245 | 12/1989 | Chuang . | |
| D. 310,542 | 9/1990 | Regnault . | |
| D. 310,684 | 9/1990 | Itoh . | |
| D. 312,658 | 12/1990 | Sumino . | |
| 1,320,946 | 11/1919 | Tischler | 401/243 X |
| 1,596,722 | 8/1926 | Doyle | 401/246 |
| 1,737,798 | 12/1929 | Kinzinger . | |
| 2,245,059 | 6/1941 | Sullivan | 24/11 M |
| 2,513,516 | 7/1950 | Randle | 24/11 F |
| 3,338,215 | 8/1967 | Chiu . | |
| 3,708,235 | 1/1973 | Kolomeir . | |
| 3,862,683 | 1/1975 | Koelichen . | |
| 3,898,009 | 8/1975 | Christensen | 401/57 |
| 3,993,409 | 11/1976 | Hart . | |
| 4,702,633 | 10/1987 | Schmidt . | |

FOREIGN PATENT DOCUMENTS

| | | | |
|---|---|---|---|
| 357413 | 8/1922 | Fed. Rep. of Germany . | |
| 2514041 | 10/1976 | Fed. Rep. of Germany . | |
| 16940 | 7/1906 | United Kingdom | 401/244 |
| 862042 | 3/1961 | United Kingdom . | |
| 917280 | 1/1963 | United Kingdom | 24/11 F |
| 2207641 | 2/1989 | United Kingdom . | |

*Primary Examiner*—Steven A. Bratlie
*Attorney, Agent, or Firm*—Ladas & Parry

[57] ABSTRACT

The tubular main body of a writing instrument has a cylinder the writing end of which is formed to include a cap-fitting portion. A gripping portion, which is formed on the cylinder below the cap-fitting portion, has an outer peripheral surface provided with a number of annular slip-preventing grooves. A cap detachably fitted on the cap-fitting portion of the cylinder includes a clip extending axially to a point in the vicinity of the gripping portion. The clip has an engaging projection formed on an underside thereof for engaging one of the slip-preventing grooves of the gripping portion when the cap is attached. When the writing instrument is clipped to the fabric on the outer side of a shirt or jacket pocket, the engaging projection on the clip and the slip-preventing groove of the gripping portion on the cylinder of the tubular main body engage each other via the fabric clamped between them.

4 Claims, 5 Drawing Sheets

WRITING INSTRUMENT WITH CAP

BACKGROUND OF THE INVENTION

This invention relates to a writing instrument such as a refillable pencil or mechanical pencil. More particularly, the invention relates to a writing instrument of the type in which a cap having a clip is detachably fitted on one end of an elongated cylinder constituting the main body of a writing instrument.

Writing instruments of the aforesaid type having a main body and a cap have long been in wide use. The main body has a cylinder the front end (the writing end) of which is provided with a cap-fitting portion. Contiguous with the cap-fitting portion on the cylinder is a gripping portion located rearwardly of the cap-fitting portion and having an outer peripheral surface provided with a number slip-preventing annular grooves juxtaposed in the axial direction.

When a writing instrument such as a refillable pencil or mechanical pencil is carried about on one's person, the major portion of the main body with the exception of the tip thereof is placed in a pocket or the like, and a fabric or the like on the outer side of the pocket is clamped between the main body of the cap and the clip of the cap fitted onto the tip of the cylinder constituting the main body of the writing instrument. The writing instrument is held in place by the clipping force of the resilient clip.

However, a problem encountered with the conventional writing instrument of the kind described above is that when the cap is subjected to an axially directed external force such as an upwardly acting force that attempts to detach the cap from the cylinder of the main body of the writing instrument while the instrument is being carried one's person, the cap detaches from the fabric on the outer side of the pocket and either or both of the cap and main body may fall out of the pocket.

SUMMARY OF THE INVENTION

An object of the present invention is to provide a writing instrument which solves the aforementioned problem without resulting in a more complicated shape and structure of the writing instrument, and without detracting from the external appearance thereof.

Another object of the present invention is to provide a writing instrument in which the cap will not become detached from a pocket or the like owing to application of an external force while the writing instrument is being carried about, thereby making it possible to prevent the cap and the main body of the writing instrument from falling out of the pocket.

According to the present invention, the foregoing objects are attained by providing a writing instrument comprising: an elongated tubular main body including a cylinder having an end face, on a writing end thereof, provided with a cap-fitting portion, and a gripping portion formed below the cap-fitting portion with a step portion intervening therebetween, the gripping portion having an outer diameter larger than that of the cap-fitting portion, and an outer peripheral surface provided with a number of annular slip-preventing grooves juxtaposed axially of the main body; and a cap detachably fitted on the cap-fitting portion of the cylinder and having an outer diameter equal to that of the gripping portion, the cap including a clip extending axially from one side of the cap to a point in the vicinity of the gripping portion, the clip having an engaging projection formed on an underside thereof facing the gripping portion, the engaging projection engaging one of the slip-preventing grooves of the gripping portion.

The writing instrument of the invention is such that when the instrument is carried about on one's person, the engaging projection protruding from the underside of the portion of the clip extending rearwardly of the cap deforms the fabric on the outer side of a pocket or the like and presses the fabric against the slip-preventing grooves provided on the outer peripheral surface of the gripping portion of the cylinder constituting the main body of the writing instrument. Thus the engaging projection and the gripping portion of the cylinder engage each other via the fabric clamped between them. As a result, the cap and the main body of the writing instrument can be prevented from falling out of the pocket or the like even if the clip is subjected to an upwardly directed external force attempting to dislodge the cap or writing instrument main body from the fabric.

Further, the cap and the main body of the writing instrument are prevented from falling out of a pocket or the like by utilizing the slip-preventing grooves provided on the gripping portion of the cylinder. Thus, the grooves used in the prior art merely for the purpose of preventing slipping are made to function also as means for preventing the cap, etc., from falling off. As a result, there is no increase in the number of component parts and the shape of each component part is not made more complicated.

Since the gripping portion of enlarged outer diameter is formed below the cap-fitting portion of the cylinder with the step portion intervening between them, the cap can be fitted onto the fitting portion to the prescribed depth by bringing the end face of the cap at its opening into abutting contact with the step portion. The cap will not readily loosen with respect to the cylinder, and the engaging projection of the clip provided on the cap can be accurately positioned opposite the slip-preventing grooves.

Furthermore, since the outer diameter of the open end of the cap is made equal to the outer diameter of the gripping portion of the cylinder, the gripping portion and the cap are perfectly flush. This means that when the writing instrument is inserted into a pocket or the like, the cap will not catch on the upper edge of the fabric on the outer side of the pocket, and therefore the force applied to the cap to extract the writing instrument from the pocket can be reduced. In addition, the overall writing instrument with the exception of the clip can be made slender in shape, thereby providing the writing instrument with an attractive external appearance.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
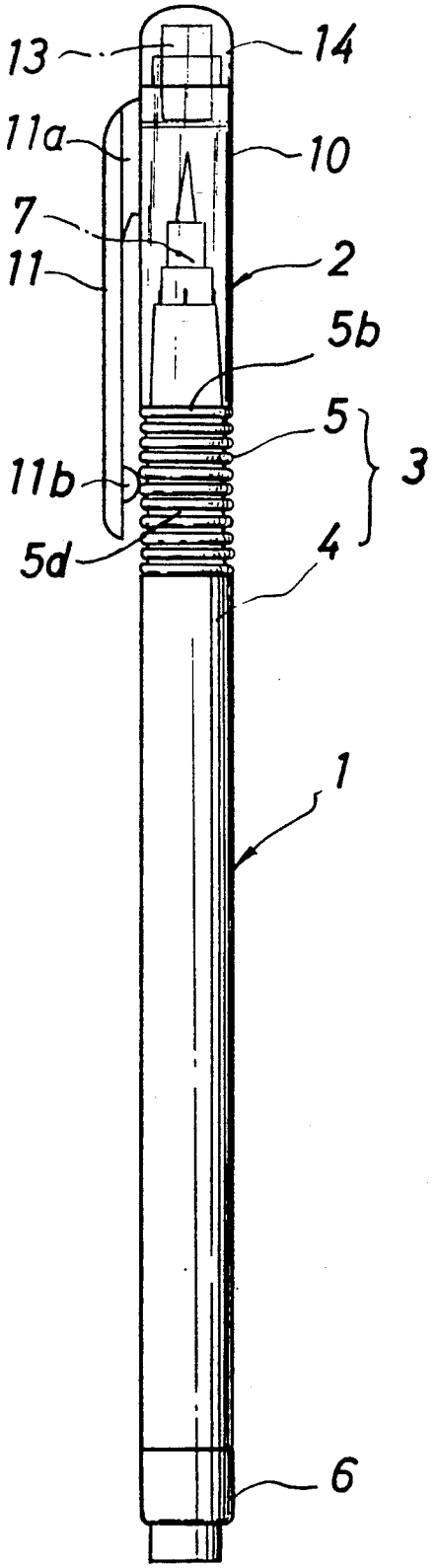
FIG. 1 is an overall view showing the external appearance of a writing instrument according to an embodiment of the present invention.

An embodiment of a writing instrument according to the present invention will now be described in detail with reference to the accompanying drawings.

As shown in FIGS. 1 through 5, a writing instrument embodying the present invention comprises a main body 1 and a cap 2. The main body 1 of the writing instrument has a cylinder 3. The latter includes a main cylinder 4 having a front end 4*a* (where "front" refers to the side on the writing end of the instrument), and a grip cylinder 5 screwed onto the front end 4*a* of the main cylinder 4 so as to be secured thereto. The grip cylinder 5 has a front end formed to include a cap fitting portion 5*a*, and a gripping portion 5*c*, the diameter of which is larger than that of the cap fitting portion 5*a*. The gripping portion 5*c* is formed below the cap fitting portion 5*a* with a step portion 5*b* intervening between them. The cap fitting portion 5*a* has a tapering outer peripheral surface and a wall thickness which becomes gradually smaller toward the front end. The gripping portion 5*c* has a number of annular slip-preventing grooves 5*d* axially juxtaposed on its outer peripheral surface, and the front portion of the inner peripheral surface of the gripping portion 5*c* is formed to have a plurality (six in this embodiment) of axially extending small projecting ribs 5*e* spaced apart equidistantly in the circumferential direction.

The main cylinder 4 has an intermediate portion 4*c* between front and rear ends 4*a*, 4*b* thereof and is formed so that the outer diameter of the intermediate portion 4*c* is equal to that of the gripping portion 5*c* of the grip cylinder 5. The rear end 4*b* (where "rear" refers to the side opposite the writing end of the instrument) of the main cylinder 4 is formed so that its outer diameter is smaller than that of the intermediate portion 4*c*, the outer peripheral surface of the lower end portion 4*b* is provided with a plurality of annular ribs 4*d*, and the inner diameter of the rear end 4*b* is made slightly larger than that of the intermediate portion 4*c*.

A rear cylinder 6 has an outer cylinder 6*a* that is press-fitted onto the lower end 4*b* of the main cylinder 4, a rear portion 6*b* the diameter of which is reduced via a step portion 6*c* which comes into abutting contact with the rear end of the main cylinder 4, and a core-retaining inner cylinder 6*d* which projects forwardly of the step portion 6*c*. The inner cylinder 6*d* is situated within the rear end 4*b* of the main cylinder 4 and has a front end portion which tapers freely toward the central axis thereof. The inner cylinder 6*d* is of reduced wall thickness and is formed to include a notch 6*e* at its front end portion.

With the exception of the front end of the grip cylinder 5 and the core-retaining inner cylinder 6*d* of the rear cylinder 6, the inner diameter of the cylinder 3 is made slightly larger than that of a holding cylinder 8 of a refill core 7, described below.

The refill core 7 is so adapted that a pencil lead 9 is secured in a reduced-diameter portion of the holding cylinder 8 in such a manner that the pencil lead 9 protrudes from the tip of the holding cylinder 8. The holding cylinder 8 has an enlarged-diameter portion formed to include a plurality (four in this embodiment) of axially extending ribs 8*a* spaced apart equidistantly in the circumferential direction, and a front end of reduced diameter.

Figure 2:
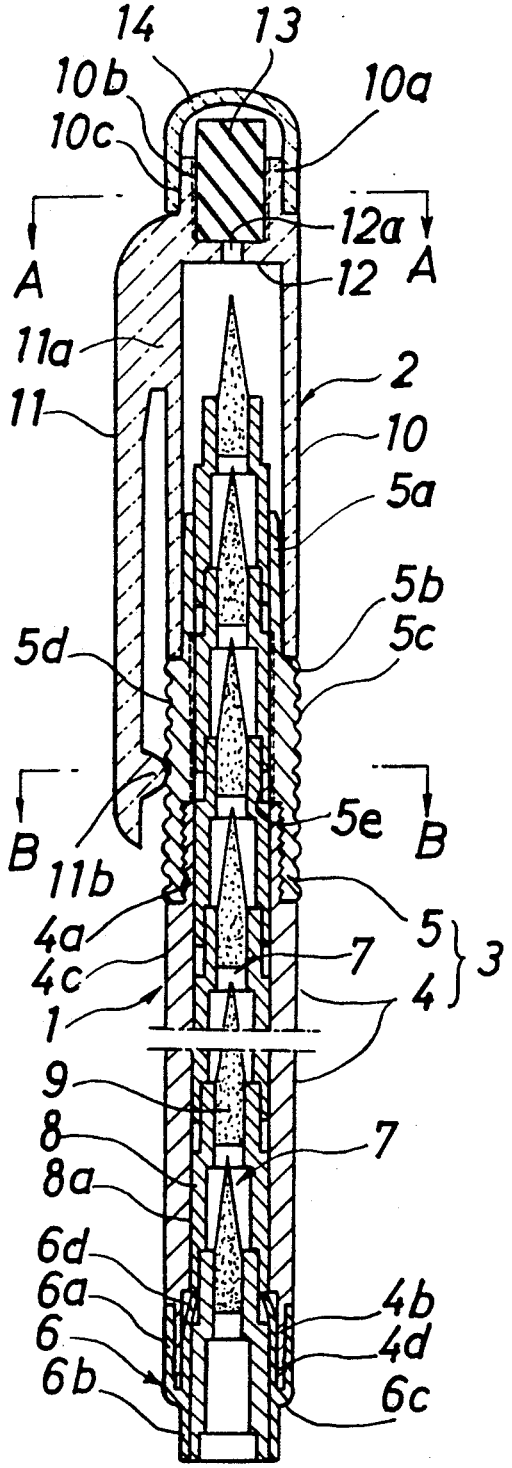
FIG. 2 is an enlarged longitudinal sectional view, a portion of which is deleted, showing the writing instrument of FIG. 1.

The interior of the cylinder 3 houses up to ten of the refill cores 7 in such a manner that the reduced-diameter front end of each holding cylinder 8, as well as its pencil lead 9, is inserted into the enlarged-diameter portion of the holding cylinder 8 in front of it, as illustrated in FIG. 2. The leading holding cylinder 8 of the refill core 7 is held resiliently by the front end portion of the grip cylinder 5, and the rearmost holding cylinder 8 of the refill core 7 is held resiliently by the core-retaining inner cylinder 6*d* of the rear cylinder 6.

Figure 3:
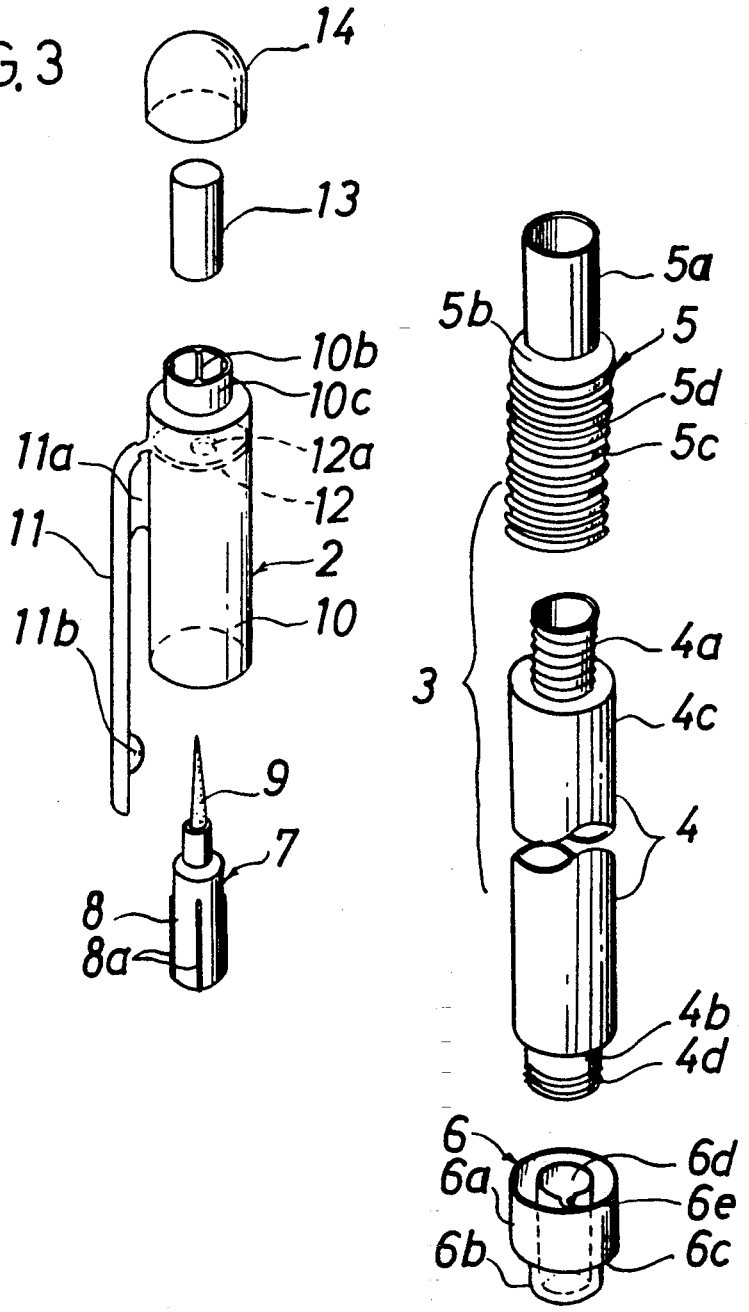
FIG. 3 is an exploded perspective view showing the writing instrument of FIG. 1.
Figure 4:
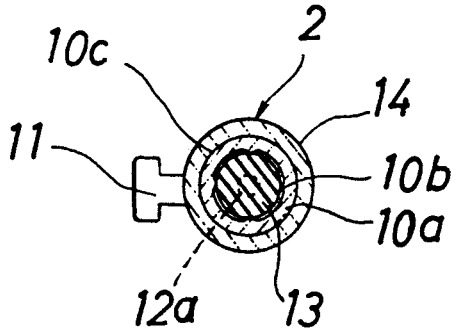
FIG. 4 is an enlarged transverse sectional view taken along line A—A of FIG. 2.
Figure 5:
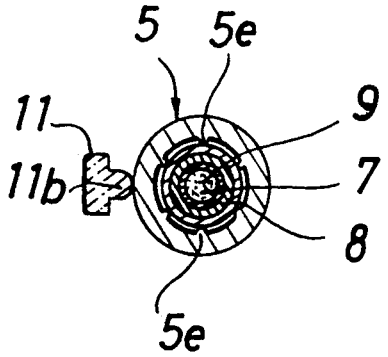
FIG. 5 is an enlarged transverse sectional view taken along line A—A of FIG. 2.

As shown in FIGS. 1, 2 and 3, the cap 2 has a substantially cylindrical cap main body 10 the outer diameter of which is equal to that of the gripping portion 5*c* of cylinder 3. The outer peripheral surface of the crown of cap main body 10 is unitarily provided with a base end 11*a* of a clip 11. The clip 11 is formed extending from the base end 11*a* toward and beyond the opening of the cap main body 10 in a direction parallel to the axis of the cap. A substantially semicircular plate-shaped engaging projection 11*b* is formed on the underside of the clip 11 near the tip on the portion thereof extending axially beyond the opening of the main body 10.

A support plate 12 having a center hole 12*a* is formed on the inner periphery of the crown 10*a* of cap main body 10. A plurality (four in this embodiment) of small ribs 10*b* are formed in equidistantly spaced relation in the circumferential direction on the inner peripheral surface of the main body 10 on the crown side of the support place 12. A columnar eraser 13 is press-fitted into the crown 10*a* of main body 10 from an opening on the crown side and is held within the crown 10*a* with its outer peripheral portion engaging the ribs 10*b*. As a result, the eraser 13 is prevented from turning about its axis and from falling out in the axial direction.

The crown 10*a* of cap main body 10 is provided on its outer peripheral surface with a cover mounting portion 10*c* of reduced outer diameter. A generally bowl-shaped cover 14 is detachably fitted onto the mounting portion 10*c* and serves to cover the eraser 13.

The cap main body 10 of the cap 2 constructed as set forth above is fitted onto, and is resiliently held by, the cap fitting portion 5*a* of the grip cylinder 5 provided on the front end of the cylinder 3 of the main body 1 of the writing instrument, and the portion of the leading core 7 projecting from the front end of the grip cylinder 5 is covered by the cap main body 10. Under these conditions, the open end of the cap main body 10 is in abutting contact with the step 5*b* of the grip cylinder 5 provided on the cylinder 3 and the engaging projection 11*b* provided on clip 11 engages one of the slip-preventing grooves 5*d* of gripping portion 5*c* with almost no gap between the engaging projection and the groove.

In this embodiment, the main cylinder 4 and the gripping cylinder 5 constituting the cylinder 3, the rear cylinder 6, the holding cylinders of the cores 7, the cap main body 10 constituting the cap 2, and the cover 14 are molded articles consisting of synthetic resin, and the grip cylinder 5, rear cylinder 6 and cap main body 10 are formed of a material exhibiting resilience.

Further, the main cylinder 4 of cylinder 3 is white in color, the grip cylinder 5, the rear cylinder 6 and the eraser 13 are of the same color, such as green, or are similar in color, and either or both of the cap 2 and cover 14 are transparent, thus providing an attractive external appearance.

Figure 6:
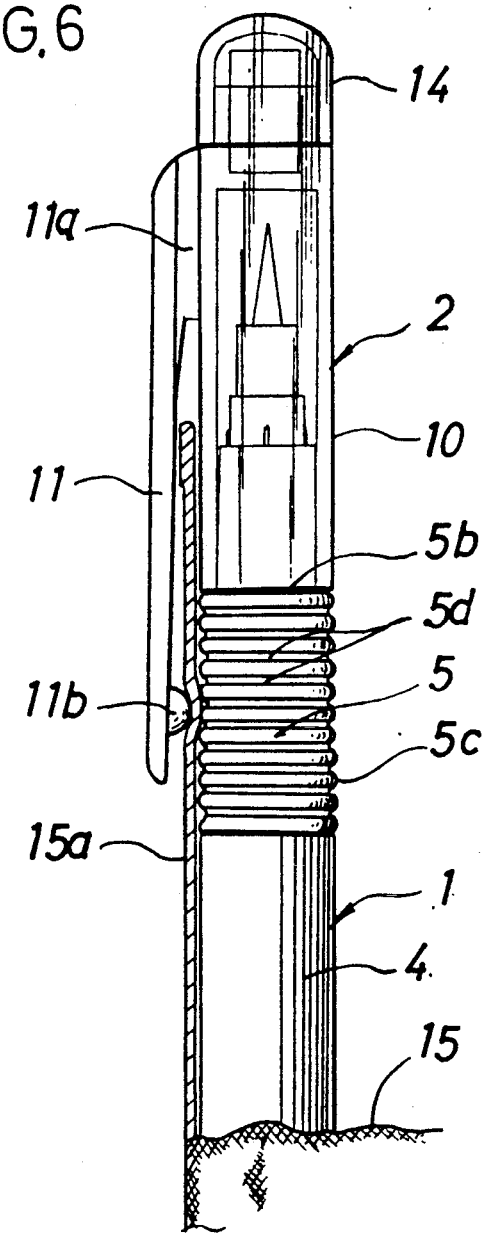
FIG. 6 is a partially enlarged sectional view showing the writing instrument of FIG. 1 clipped on a pocket.

In order to carry about the refillable pencil of this embodiment, the main body 1 of the writing instrument is inserted into a jacket pocket 15 from above, as shown in FIG. 6, and fabric 15*a* on the outer side of the pocket 15 is resiliently clamped between the clip 11 on one side and the cap main body 10 and cylinder 3 of the writing instrument main body 1 on the other side.

Under these conditions, the engaging projection 11*b* on the clip 11 deforms the fabric 15*a* on the outer side of the pocket 15 and presses the fabric against one of the annular slip-preventing grooves 5*d* provided on the outer peripheral surface of the gripping portion 5*c* of cylinder 3. As a result, the engaging projection 11*b* and the cylinder 3 are engaged via the fabric 15*a*. Consequently, the cap 2 and the main body 1 of the writing instrument can be prevented from falling out of the pocket 15 even if the clip 11, which is situated on the outer side of the fabric 15*a*, is subjected to an upwardly directed external force attempting to dislodge the cap or writing instrument main body from the fabric.

The use of the refillable writing instrument according to this embodiment will now be described.

The cap main body 10 of the cap 2 is detached from the cap fitting portion 5*a* of the grip cylinder 5 provided on the front end of the cylinder 3 of main body 1, and the pencil lead 9 of the leading refill core 7 is used to write on paper or the like while the writer grasps the gripping portion 5*b* of the grip cylinder 5.

During writing, writing pressure is applied from the front end of the pencil lead 9 of the leading core 7 toward the rear of the writing instrument main body 1. The writing pressure is borne by the holding cylinder 8 of the leading core 7. Since the holding cylinder 8 is resiliently retained in the cap fitting portion 5*a* of the grip cylinder 5, the writing pressure is in turn borne by the main cylinder 4 to which the grip cylinder 5 is secured by being screwed thereon The holding cylinder 8 of the leading core 7 is supported on the immediately underlying holding cylinder 8 of the next core 7, this holding cylinder 8 is supported on its underlying holding cylinder, and so forth. Therefore, the writing force is transmitted to the holding cylinder that is second from the rear. This holding cylinder 8 received by the front end of the core-retaining inner cylinder 6*d*, the front end of which enlarges diametrically so that the writing pressure is borne by the inner peripheral surface of the main cylinder 4. In addition, the writing pressure is borne by the main cylinder 4 via the holding cylinder 8 of the rearmost core 7, which cylinder is resiliently fitted into the inner cylinder 6*d*, and via the rear cylinder 6 which resiliently retains this holding cylinder 8. Accordingly, the writing pressure applied to the leading core 7 is borne by the main cylinder 4 upon being dissipated, whereby the leading core 7 will not retract or flex sideways owing to the writing pressure.

When the pencil lead 9 of the leading core 7 becomes unusable because of wear or breakage, the writer grasps the front end of this holding cylinder 8 and pulls it forwardly out of the cylinder 3. The holding cylinder 8 thus extracted is then pressed from its tip into the holding cylinder 8 of the rearmost core 7, whereby each core 7 is advanced so that the core 7 which was second from the front is made the leading core. Writing may then be performed using the pencil lead 9 of this core. Thereafter, by repeating this operation, a large number of characters can be written using all of the cores 7 provided within the cylinder 3. When all of the cores 7 become unusable, new cores 7 can be loaded in the cylinder 3 to replace the unusable cores 7.

The eraser 13 is used upon removing the cover 14 from the cover mounting portion 10*c* of cap 2. After the eraser 13 has been used, the cover is again fitted onto the mounting portion 10*c*.

In this embodiment, the support plate 12 provided on the cap main body 10 is furnished with the center hole 12*a*, as shown in FIGS. 2 and 3. This makes it possible to remove the eraser 13 from the crown 10*a* of the cap main body 10 by passing a slender rod through the center hole 12*a* from the open end of the cap main body 10 and forcing out the eraser 13 by means of the rod.

In the present invention, the illustrated embodiment is such that the main cylinder and grip cylinder of the cylinder are separate bodies. However, these can be molded as a single part. In addition, the clip and the cap can be made separate bodies, and these can be fixed together or connected to each other and constrained in the axial direction. Furthermore, the slip-preventing grooves and the cross-sectional shape of the engaging projection of the clip can be modified as required, and the engaging projection can be made to press against the slip-preventing grooves.

Further, the present invention is not limited to a refillable pencil but is applicable also to a wide variety of writing instruments, such as a mechanical pencil, ballpoint pen, etc.

Thus, as described above, the writing instrument of the present invention is characterized by comprising an elongated tubular main body and a cap. The main body includes a cylinder having an end face, on a writing end thereof, provided with a cap-fitting portion, and a gripping portion formed below the cap-fitting portion with a step portion intervening therebetween. The gripping portion has an outer diameter larger than that of the cap-fitting portion, and an outer peripheral surface provided with a number of annular slip-preventing grooves juxtaposed axially of the main body. The cap is detachably fitted on the cap-fitting portion of the cylinder and has an outer diameter equal to that of the gripping portion, the cap includes a clip extending axially from one side of the cap to a point in the vicinity of the gripping portion. The clip has an engaging projection formed on an underside thereof facing the gripping portion, and the engaging projection engages one of the slip-preventing grooves of the gripping portion.

As a result, a number of advantages are obtained

Specifically, the writing instrument of the invention is such that when the instrument is carried about on one's person, the engaging projection protruding from the underside of the portion of the clip extending rearwardly of the cap deforms the fabric on the outer side of a pocket or the like and presses the fabric against the slip-preventing grooves provided on the outer peripheral surface of the gripping portion of the cylinder constituting the main body of the writing instrument. Thus the engaging projection and the gripping portion of the cylinder engage each other via the fabric clamped between them, as shown in FIG. 6. As a result, the cap and the main body of the writing instrument can be prevented from falling out of the pocket or the like even if the clip is subjected to an upwardly directed external force attempting to dislodge the cap or writing instrument main body from the fabric.

Further, the cap and the main body of the writing instrument are prevented from falling out of a pocket or the like by utilizing the slip-preventing grooves provided on the gripping portion of the cylinder. Thus, the grooves used in the prior art merely for the purpose of preventing slipping are made to function also as means for preventing the cap, etc., from falling off. As a result, there is no increase in the number of component parts and the shape of each component part is not made more complicated.

Since the gripping portion of enlarged outer diameter is formed below the cap fitting portion of the cylinder with a step portion intervening between them, the cap can be fitted onto the fitting portion to the prescribed depth by bringing the end face of the cap at its opening into abutting contact with the step portion. The cap will not readily loosen with respect to the cylinder, and the engaging projection of the clip provided on the cap can be accurately positioned opposite the slip-preventing grooves.

Furthermore, since the outer diameter of the open end of the cap is made equal to the outer diameter of the gripping portion of the cylinder, the gripping portion and the cap are perfectly flush. This means that when the writing instrument is inserted into a pocket or the like, the cap will not catch on the upper edge of the fabric on the outer side of the pocket, and therefore the force applied to the cap to extract the writing instrument from the pocket can be reduced. In addition, the overall writing instrument with the exception of the clip can be made slender in shape, thereby providing the writing instrument with an attractive external appearance.

As many apparently widely different embodiments of the present invention can be made without departing from the spirit and scope thereof, it is to be understood that the invention is not limited to the specific embodiments thereof except as defined in the appended claims.

What is claimed is:

1. A writing instrument comprising:

an elongated tubular main body including a cylinder having an end face on a writing end thereof, a cap-fitting portion, and a gripping portion formed below said cap-fitting portion with a step portion intervening therebetween, said gripping portion having an outer diameter larger than that of said cap-fitting portion and an outer peripheral surface provided with a plurality of annular slip-preventing grooves, said gripping portion further comprising an internal surface with a plurality of axially extending ribs over at least a part of said internal surface; and a cap detachably fitted on said cap-fitting portion of said cylinder and having an outer diameter equal to that of said gripping portion, said cap including a clip extending coaxially with and from said cap to a point in the vicinity of said gripping portion, said clip having an engaging projection formed thereon facing said gripping portion, said engaging projection engaging one of said grooves of said gripping portion.

2. A writing instrument as claimed in claim 1 wherein the plurality of axially extending ribs are equispaced from each other.

3. A writing instrument as claimed in claim 1 wherein the internal surface of the gripping portion has six axially extending ribs.

4. A writing instrument as claimed in claim 1 further comprising a plurality of cores, each core having a holding cylinder, and being located within the cylinder, wherein each holding cylinder has a plurality of axially extending ribs equispaced thereabout, the ribs of the holding cylinder cooperating with the ribs of the gripping portion to prevent rotation of the core within the cylinder.

* * * * *